US005704143A

United States Patent [19]

Kubicz

[11] Patent Number: 5,704,143

[45] Date of Patent: Jan. 6, 1998

[54] DUAL SURGE IRON WITH STEAM GENERATING AREAS

[75] Inventor: Edward M. Kubicz, Torrington, Conn.

[73] Assignee: Black & Decker Inc., Newark, Del.

[21] Appl. No.: 700,066

[22] Filed: Aug. 19, 1996

[51] Int. Cl.[6] ..... D06F 75/18

[52] U.S. Cl. ..... 38/77.83

[58] Field of Search ..... 112/77.83, 77.8, 112/77.81, 77.82, 93; 219/245

[56] References Cited

U.S. PATENT DOCUMENTS

| | | | |
|---|---|---|---|
| 2,384,839 | 9/1945 | Kistner | 38/77 |
| 2,637,126 | 5/1953 | Fitzsimmons | 38/77 |
| 3,304,636 | 2/1967 | Vieceli et al. | 38/77 |
| 3,407,522 | 10/1968 | Jepson et al. | 38/78 |
| 3,711,972 | 1/1973 | Risacher | 38/77.83 |
| 3,820,259 | 6/1974 | Flowers | 38/77.5 |
| 3,828,452 | 8/1974 | Eaton et al. | 38/77.83 |
| 3,872,613 | 3/1975 | Davidson et al. | 38/77.83 |
| 3,919,793 | 11/1975 | Toft et al. | 38/77.83 |
| 4,045,894 | 9/1977 | Toft et al. | 38/77.83 |
| 4,077,143 | 3/1978 | Walker et al. | 38/77.83 |
| 4,091,551 | 5/1978 | Schaeffer | 38/77.83 |
| 4,107,860 | 8/1978 | Coggiola | 38/77.83 |
| 4,414,766 | 11/1983 | Schwob | 38/77.83 |
| 5,115,117 | 5/1992 | Amiot et al. | 219/254 |
| 5,279,054 | 1/1994 | Chasen | 38/77.7 |
| 5,279,055 | 1/1994 | Eckert et al. | 38/77 |
| 5,307,573 | 5/1994 | Watkins | 38/77.8 |
| 5,345,703 | 9/1994 | Farrington et al. | 38/77.83 X |

*Primary Examiner*—Ismael Izaguirre
*Attorney, Agent, or Firm*—Barry E. Deutsch

[57] ABSTRACT

An electric steam iron, with a soleplate, has a water reservoir which feeds a primary steam generating area and secondary surge steam generating areas. The primary steam generating area feeds steam to a distribution chamber through a first passage, and the surge steam areas feed steam through a second passage which is separate and remote of the first passage.

17 Claims, 4 Drawing Sheets

DUAL SURGE IRON WITH STEAM GENERATING AREAS

CROSS-REFERENCE TO RELATED APPLICATIONS

The present invention relates to U.S. application Ser. No. 08/573,985 entitled "STEAM SURGE FOR AN ELECTRIC STEAM IRON" filed in the name of James E. Chasen, on Dec. 18, 1995 and which application being commonly assigned with the Assignee of the present invention.

BACKGROUND OF THE INVENTION

The present invention relates to electric steam irons, and more particularly, to a dual surge unit providing an iron with improved high performance surge steam capabilities and reduced manufacturing costs.

Surge irons which are presently known, require a base steam rate of between 15 to 20 grams per minute for primary steam generation and further must simultaneously support a surge steam rate on the order of more than 50 grams per minute at a 1200 W rating. The prior art steam irons are usually designed with front surge drop points which are directed onto a large mass of aluminum which is in turn located in contact with the iron heating element. This large metallic mass provides a heat storage, but undesirably creates a heavy iron which is more likely to be damaged if dropped.

Such irons additionally are generally perceived by the user to cause greater fatigue as the iron is used more and more. Moreover, the fabrication of such large mass aluminum formations on the soleplate drastically increases the cost of fabrications, and produces a soleplate in which a thermal gradient is not symmetrical which in turn may cause scorching of some fabrics.

As disclosed in the above referenced co-pending and commonly assigned patent application, there has been developed by the assignee of the present invention, irons which generate surge steam without the need to use large mass aluminum material such as discussed above. These irons effect steam surge by impinging water directly onto the heating element which is encased in the soleplate. While such irons have enjoyed much success, it has been found that directing water immediately onto the heating element may lead to possible problems with water spotting due to the direct flow of water onto the intensely hot surface of the heating element.

That is, due to what has been known as the Leidenfrost effect, water impinging upon the surface of an extremely hot surface, such as that found on the heating element of an iron, undesirably causes water droplets or beads to be formed rather than causing the water to form steam. Also, in the above-referenced copending application, surge steam and the steam generated from the primary generating area are passed into a common rear chamber. While this arrangement is acceptable for a system where surge steam is generated at a single source point, it nevertheless has been found preferable to direct surge steam into the steam distribution chamber through a passage which is separate from the primary steam generation area so as to prevent backflow into the primary steam chamber.

Accordingly it is an object of the present invention to provide a dual surge high performance steam iron which eliminates the heretofore problems of using large mass aluminum formations on the soleplate in order to effect surge steam.

Still a further object of the invention is to provide a high performance steam iron of the aforementioned type wherein steam directed from a surge steam generation point or points is vented to a steam distribution area separately from steam generated from the primary steam area.

Yet still another object of the invention is to provide an electric iron of the aforementioned type wherein surge steam generation is produced without the undesirable effects of beading of water when contacting the heating element.

Further objects and advantages of the present invention will become apparent by the following description in the appended claims.

SUMMARY OF THE INVENTION

The invention resides in an electric steam iron having a soleplate with a heating element, a water reservoir and means for depositing water from the reservoir onto the soleplate at a first location for ordinary steam generation and at at least a second location for surge steam generation. The soleplate has a first primary steam generating area with the first location thereat and at least one substantially separate second surge steam generating area with the at least one second location located thereat. The first primary steam generating area communicates with the steam distribution chamber directly through a first passage and the at least one second surge steam generating area communicates with the steam distribution chamber through a second passage located substantially remotely of and separately from the first passage.

Ideally, the at least one second location is located laterally offset of the heating element and the at least one second surge steam generating area makes up part of a generally U-shaped chamber.

Two second locations may be provided each defined by collecting pockets each disposed on symmetrically opposite sides of the generally U-shaped steam generating area. Each of the collecting pockets corresponds to a point laterally inwardly or outwardly of the heating element.

Preferably, each of the collecting pockets corresponds to a portion of a separating wall disposed in close proximity with the heating element and communicating with water deposited from the reservoir. The passage from the first primary steam generating area to the steam distributing chamber in the iron is located at the rear of the iron and the passage from the second steam generating area to the steam distributing chamber in the iron is located at the front of the iron.

Desirably, each of the collecting pockets communicates with water deposited from the reservoir through a flow splitter.

It is also desirable that the collecting pockets communicate with the generally U-shaped steam generating area through necked wall portions.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
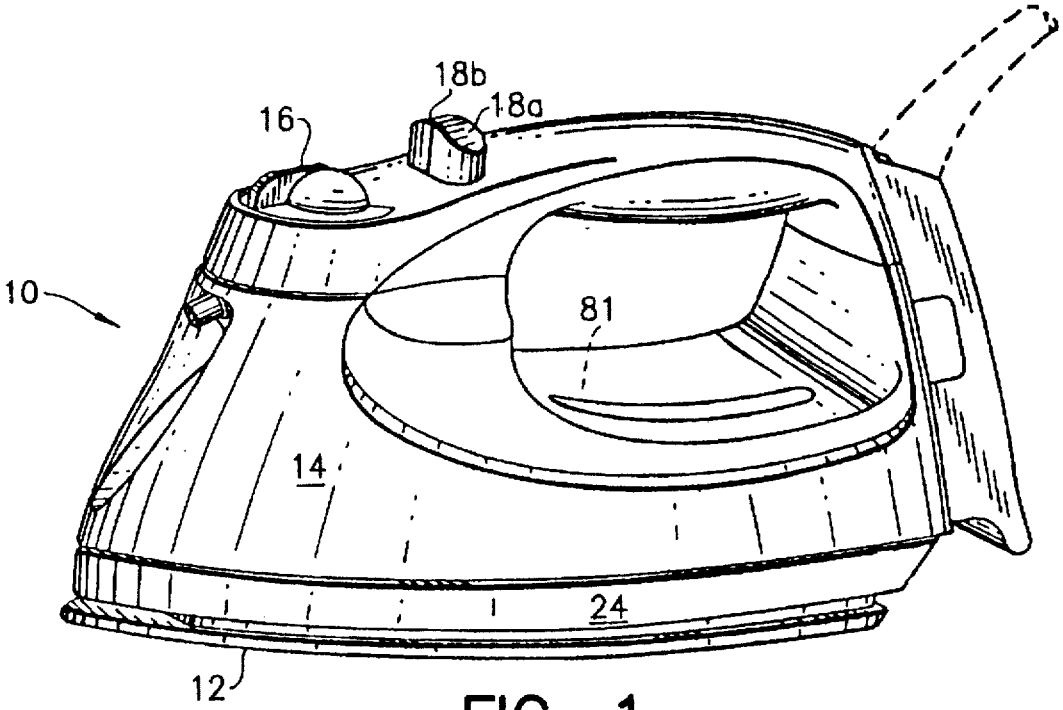
FIG. 1 is perspective view of an electric steam iron incorporating features of the present invention.

Referring to FIG. 1, there is shown an electric steam iron 10 incorporating features of the present invention. Although the present invention will be described with reference to the embodiments shown in the drawings, it should be understood that the present invention may be incorporated into various different types of irons. In addition, any suitable size, shape or type of elements or material could be used. Also, in the embodiments of FIGS. 3 and 4, identical reference numbers shown in these figures should be understood to mean similar components between the two designs.

Figure 2:
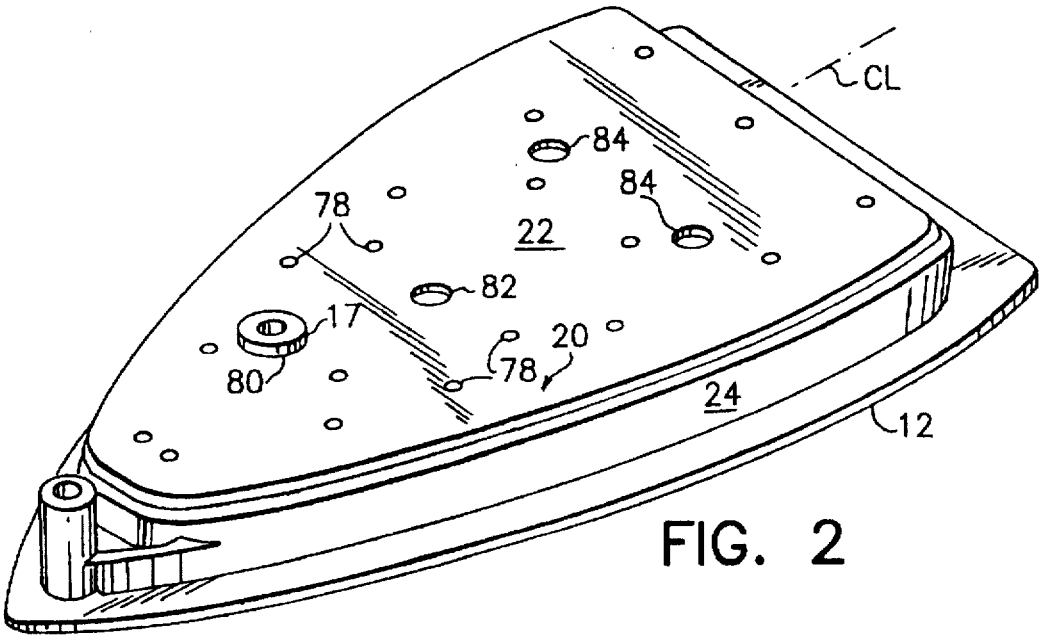
FIG. 2 is a perspective view of the front of the soleplate with the cover attached.

Referring to FIG. 2, a perspective view of the soleplate 12 of the iron is shown. The iron 10 generally comprises the soleplate 12 extending symmetrically about a centerline CL, a housing 14, a temperature control knob 16 which is articulated to a thermostat boss 17 extending through the cover 22, and a spray button 18*a* and a surge button 18*b*. The soleplate has a raised wall 24 in a general triangular shape that forms the side walls for the steam chamber 20. A cover 22 is attached to the top of the wall 24 to form the top of the steam chamber.

Figure 3:
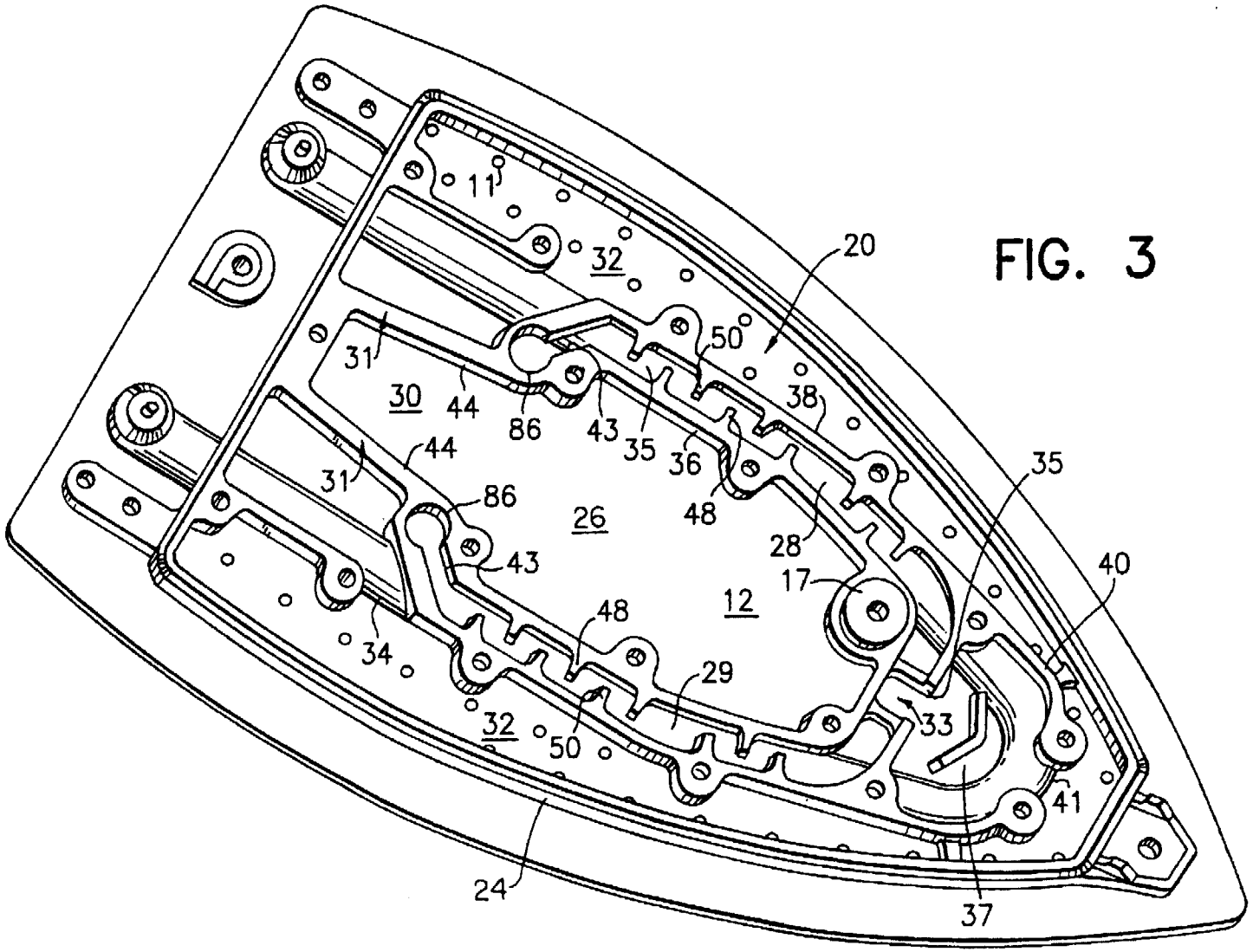
FIG. 3 is a perspective view of the soleplate of the iron shown in FIG. 2.

The steam chamber 20, as best seen in FIG. 3 has six areas or chambers; a primary steam generating area 26, first and second surge steam areas 28 and 29, a rear chamber 30, steam distribution chamber 32, and drop points 86,86. Passages 31,31 connect the rear chamber 30 to the steam distribution chamber 32 at one end thereof. Passages 33 and 35 connect the surge steam areas 28,29 to the steam distribution chamber 32 at the front end of the iron opposite of the rear chamber 30.

Referring back to FIG. 2, the soleplate 12 is shown with the steam chamber cover 22 attached. The soleplate 12 has rivet sections 78 that extend through rivet holes in the cover and are deformed to attach the cover 22 to the soleplate 12. The perimeter of the cover 22 is sealed with the top of the raised wall 24. The cover 22 also has four other holes 80, 82, and 84, 84. The first hole 80 has the top of the thermostat boss 17 extending therethrough. The second hole 82 is an entrance into the primary steam generating area 26. The third and fourth holes 84,84 each provide an entrance into the surge steam generating areas 28,29. Mounted on the thermostat boss 17 is a thermostat (not shown). The second, third and fourth holes are fed by water from a reservoir enclosed in the housing as shown schematically at element 81 in FIG. 5. While not shown, it should be understood that located in the second hole 82 is a valve with a valve rod that is moved by the temperature control knob 16 as described in U.S. patent application Ser. No. 08/512,852, filed Aug. 9, 1995, to introduce water from the reservoir into the primary steam generating area 26, and which patent is hereby incorporated by reference in its entirety. Also, it is noted that while shown in a frontal disposition in FIG. 3, the boss 17 may alternatively be positioned in the rear of the steam chamber.

Located in the soleplate 12 is a heating element 34 that has a general "U" or "V" shape about the steam chamber 20. The heating element 34 is encased in the soleplate, except at the rear end of the soleplate where electrical connections are made. Thus, a general raised ridge 35 is formed in the soleplate 12 in which the heating element 34 is located. Extending upwards from the top surface 1 of the soleplate in the steam chamber 20 are first and second or inner and outer walls respectively labelled 36 and 38. Both the inner and outer walls 36 and 38 extend upwardly from the surface i and meet the bottom surface of the cover 22 to seal off the baffle chamber from the area 26, except where portions of these walls define a passage to the steam distribution chamber 32. The thermostat mounting boss 17 also extends upward at the primary steam generating area 26.

The first wall 36 surrounds the primary steam generating area 26 and the boss 17. The first wall 36 has an open rear end with a low raised lip 44 about the rear chamber 30 thereby allowing passage of steam from within the primary steam chamber 26 outwardly thereof and into the steam distribution chamber 32. The second wall 38 substantially follows the path of the first wall about the soleplate 12 and is maintained in a parallel spaced apart relationship therefrom in order to form the first and second surge steam areas 28 and 29.

In the embodiment of FIG. 3, the passage 33 opening the surge steam areas 28,29 to the steam distribution area 32 at the front of the iron takes the form of a first gap 35 in the second wall 38 which communicates with an intermediate chamber 37 defined by a third wall 40 which is contiguous with the second wall 38 and communicates with the distribution area 32 through a second gap 41 disposed between the area 32 and the intermediate chamber 37. The gap 35 is a water trap which increases thermostat response in the event of a flooded condition.

Figure 4:
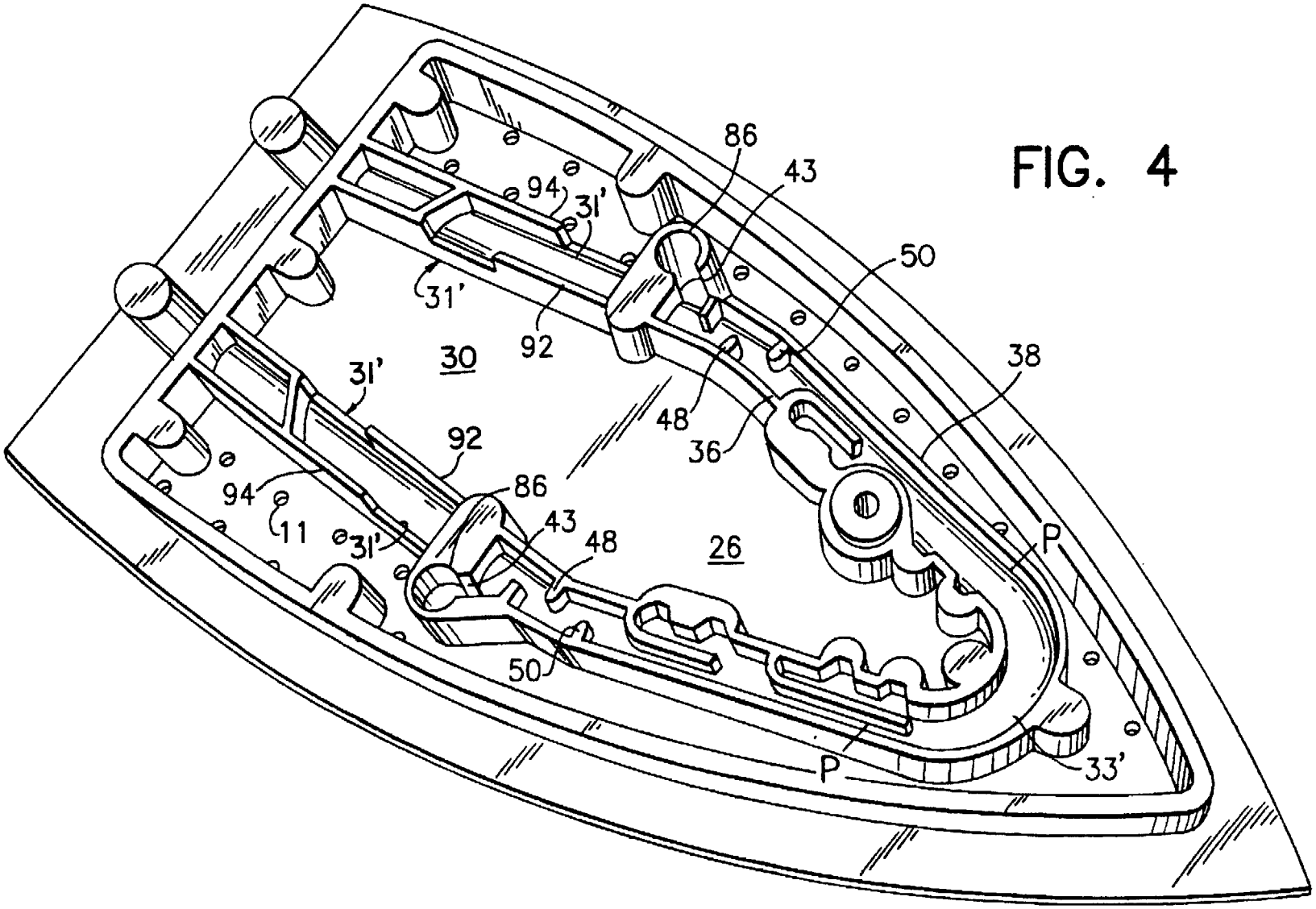
FIG. 4 is a perspective view of a second alternate embodiment of the soleplate with the cover removed.

In the embodiment of FIG. 4, the forward passage 33' takes the form of a downward taper in the second wall 38 extending from about points P,P forwardly to the front of the iron so as to leave a spacing between the undersurface of the cover 20 and the immediate frontal area of the second wall 38. This spacing communicates directly with the steam distribution chamber 32 to introduce surge steam directly to the chamber 32 for passage outwardly of the soleplate through openings 11.

As illustrated in FIGS. 2, 3 and 4, the third and fourth surge steam water holes 84,84 are each located offset from the centerline CL of the soleplate 12. Furthermore, each of the holes 84, 84 is located immediately above a collecting pocket 86 which is integrally formed as part of the structure of the soleplate and is itself offset from the raised ridge 35 of the heating element 34 so as to collect water which flows through each of the holes 84,84 and introduce the collected water against the side surface of the heating element in order to create surge steam. Each of the collecting pockets 86,86 is formed from cooperating portions of the first and second walls 36 and 38 which connect to create a partially circular area.

As can be seen in FIGS. 3 and 4, in the embodiment of FIG. 3, each of the collecting pockets 86,86 is located inboard of the heating element or the ridge 35, while in the embodiment of FIG. 4, the collecting pockets are each disposed outwardly thereof. In either case, each collecting pocket 86,86 communicates with the heating element through a necked portion 43 formed from portions of the first and second walls 36 and 38 which direct water from the pockets onto the side surface of the heating element 34. Also, it should be understood that collecting pockets 86, 86 can be directly on the heating element with or without a necked portion.

Surge steam created at this point travels to the distributing chamber 32 through the first and second surge steam areas 28 and 29 which run substantially lengthwise of the iron following the path of the heating element. Each of the surge steam areas 28 and 29 includes baffling effected by ribs 48, 50 which maximize the travel distance of the steam before exiting the soleplate to reduce the tendency for water spotting.

In the embodiment of FIG. 3, the low raised lip 44 about the rear chamber 30 allows passage of steam generated from within the primary steam chamber to pass outwardly to the steam distribution chamber 32 at the rear of the iron. Alternatively, in the embodiment of FIG. 4, the rear chamber 30 is defined by separation walls 92 and 94 which are in effect extensions of the first and second walls 36 and 38, respectively, and are disposed on either side of the raised ridge 35. The separation walls furthermore extend between the soleplate top surface 1 and the lower surface of the cover 20, except for passages 31',31' which are defined by cut away portions of walls 92 and 94 to provide communication with the steam distribution chamber 32. As shown in the drawings, each pair of the passages 31',31' is staggered in the direction of the centerline CL so as to cause the travel path of the primary steam to pass over the heating element 34.

Thus it should be understood that primary steam generated at area 26 communicates with the steam distribution chamber 32 through passages 31 or 31' at the rear of the iron whereas surge steam which is generated in the areas 28,29 is introduced into the distribution chamber 32 at the front of the iron through passage 33 or 33. Separation of the surge steam exit from the primary steam exit is intentionally done to prevent fast moving surge steam from entraining or carrying water from the primary steam generating area 26 with the surge steam which could otherwise cause water spotting problems.

Figure 5:
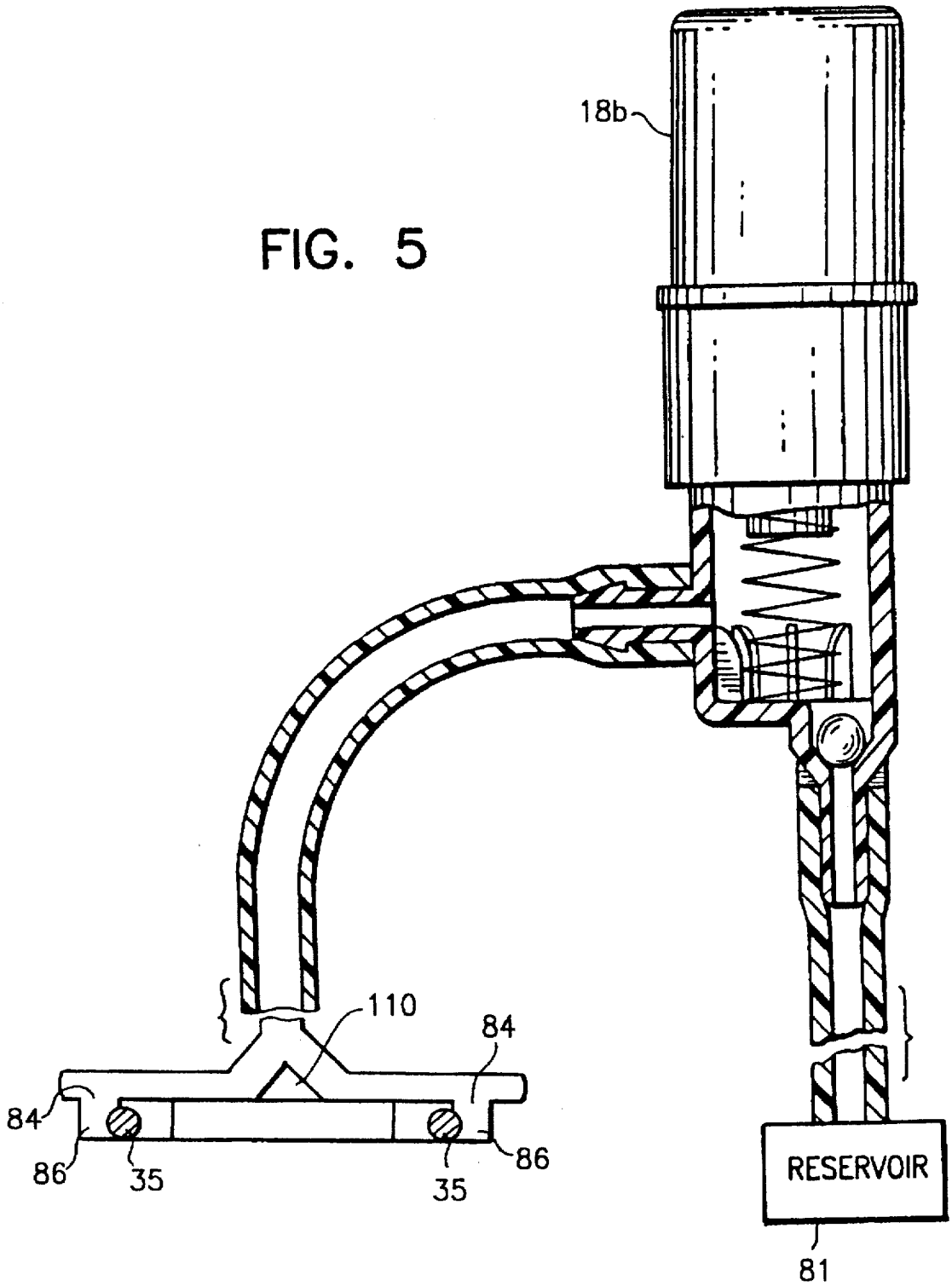
FIG. 5 is a schematic view of the water flow delivery mechanism of the iron.

Referring to FIGS. 2, 3 and 5, it should be seen that when the user pushes the surge steam button **18*b*, water is delivered at the collecting pockets 86 adjacent the heating element 34. As noted above, each collecting pocket is located offset from the heating element. This is done to avoid depositing water for surge steam generation directly onto the heating element 34, but still providing the fastest means for generating fast moving steam. Balance of water flow to the third and fourth openings in the cover 20 is accomplished by splitting the water flow from the reservoir 81 at a flow divider 110 so that water flows equally into each collecting pocket 86,86 through the respective openings 84,84**.

It should be understood that the foregoing description is only illustrative of the invention. Various alternatives and modifications can be devised by those skilled in the art without departing from the spirit of the invention. For example, although the tops of the walls 36 and 38 preferably normally contact the bottom of the cover 22, it is well within the purview of the invention to form the first wall 36 slightly lower than the second wall 38 such that if pressure in the surge steam generating areas 28,29 becomes excessive, a path between the top of the first wall 36 and the cover 22 will open before a path between the top of the second wall 38 and the cover 22 opens.

Accordingly, the present invention is intended to embrace all such alternatives, modifications and variances which fall within the scope of the appended claims.

What is claimed is:

1. In an electric steam iron having a soleplate with a heating element, a water reservoir and means for depositing water from the reservoir onto the soleplate at a first location for ordinary steam generation and at least one second location for surge steam generation and a steam distribution chamber for transmitting ordinary steam and surge steam from said soleplate, wherein the improvement comprises:

the soleplate having a first primary steam generating area with the first location thereat and at least one substantially separate second surge steam generating area with the at least one second location located thereat, said first primary steam generating area communicating with said steam distribution chamber directly through a first passage and said at least one second surge steam generating area communicating with said steam distribution chamber through a second passage located substantially remotely of and separately from said first passage;

said at least one second location being located laterally offset of said heating element;

said at least one second surge steam generating area makes up part of a generally U-shaped chamber; and said at least one second location includes two locations each defined by collecting pockets and each disposed on symmetrically opposite sides of said generally U-shaped steam generating area.

2. An iron as defined in claim 1 further characterized in that each of said collecting pockets corresponds to a point laterally inwardly of said heating element.

3. An iron as defined in claim 2 further characterized in that each of said collecting pockets is located laterally outwardly of said heating element.

4. An iron as defined in claim 3 further characterized in that each of said collecting pockets corresponds to a portion of a separating wall disposed in close proximity with the heating element and communicating with water deposited from said reservoir.

5. An iron as defined in claim 4 further characterized in that each of said collecting pockets communicates with said generally U-shaped steam generating area through a necked wall portion.

6. An iron as defined in claim 1 further characterized in that said first passage from said first primary steam generating area to said steam distributing chamber in said iron is located at the rear of the iron and said at least one second surge steam generating area being located directly on said heating element.

7. An iron as defined in claim 6 further characterized in that said second passage from said second steam generating area to said steam distributing chamber in said iron is located at the front of the iron.

8. An iron as defined in claim 1 further characterized in that each of said collecting pockets communicates water deposited from said reservoir through a flow splitter.

9. In an electric steam iron having a soleplate with a heating element, a water reservoir and means for depositing water from the reservoir onto the soleplate at a first location for ordinary steam generation and a steam distribution chamber for transmitting ordinary steam and surge steam from said soleplate, and at second locations for surge steam generation, wherein the improvement comprises:

the soleplate having a first primary steam generating area with the first location thereat and substantially separate second surge steam generating areas, the second locations located in the second surge steam generating areas and communicating with said steam distribution chamber directly through second passages which proceed from the rear of the iron forwardly thereof, and said first primary steam generating area communicating with said steam distribution chamber at a first passage means located substantially at the rear of the iron and said second surge steam generating area communicating with said steam distribution chamber at the front of said iron through a second passage means disposed remotely of and separately of the first passage means.

10. An iron as defined in claim 9 further characterized in that said second locations being located laterally offset of said heating element.

11. An iron as defined in the claim 10 wherein said second surge steam generating areas define a generally U-shape.

12. An iron as defined in claim 11 further characterized in that said second locations include two collecting pockets each disposed on symmetrically opposite sides of said generally U-shaped steam generating area.

13. An iron as defined in claim 12 further characterized in that each of said collecting pockets corresponds to a point laterally inwardly of said heating element.

14. An iron as defined in claim 12 further characterized in that each of said collecting pockets is located laterally outboard of said heating element.

15. An iron as defined in claim 12 further characterized in that each of said collecting pockets corresponds to a portion of a separating wall disposed in close proximity with the heating element and communicating with water deposited from said reservoir.

16. An iron as defined in claim 15 further characterized in that each of said collecting pockets communicates with said generally U-shaped steam generating area through a necked wall portion.

17. An iron as defined in claim 11 further characterized in that each of said collecting pockets communicates with water deposited from said reservoir through a flow divider.

* * * * *